United States Patent [19]

Wong

[11] 4,152,220

[45] May 1, 1979

[54] ELECTROPLATING SOLUTIONS FOR THE ELECTRODEPOSITION OF ALUMINUM AND METHOD OF MAKING SAME

[75] Inventor: Jack Y. Wong, San Jose, Calif.

[73] Assignee: Alumatec, Inc., Lompoc, Calif.

[21] Appl. No.: 867,768

[22] Filed: Jan. 9, 1978

Related U.S. Application Data

[63] Continuation-in-part of Ser. No. 734,677, Oct. 21, 1976, abandoned, which is a continuation-in-part of Ser. No. 645,552, Dec. 31, 1975, Pat. No. 4,003,804.

[51] Int. Cl.[2] ..... C25D 3/44

[52] U.S. Cl. ..... 204/14 N

[58] Field of Search ..... 204/14 R, 14 N

[56] References Cited

U.S. PATENT DOCUMENTS

| | | | |
|---|---|---|---|
| 2,170,375 | 8/1939 | Mather et al. | 204/14 N |
| 3,997,410 | 12/1976 | Gileadi et al. | 204/14 N |

OTHER PUBLICATIONS

The Electrochemical Society Preprint 65-2, (1934), pp. 25-38.

*Primary Examiner*—T. M. Tufariello

*Attorney, Agent, or Firm*—I. Morley Drucker

[57] ABSTRACT

Aluminum or an alloy thereof is electroplated upon electrically conductive substrates by immersing the substrate as a cathode in a novel stable electrolyte, made by (a) reacting aluminum with a hydrogen halide or a halogen and hydrogen halide, in the absence of water, but in one of several organic, non-Lewis base solvents or mixtures thereof to form an intermediate aluminum halide cation in solution, the concentration of the aluminum cation and the concentration of hydrogen ion in solution being, respectively, below about 5.0 M and 0.4 M and preferably containing an aluminum cation concentration extending between 2.7 M and 4.2 M and a $[H^+]$ ion concentration extending between about 0.01 M and about 0.3 M, the exact maximum amount of $[H^+]$ ion concentration depending upon the aluminum ion concentration (there is a direct, substantially linear, relationship between the $[Al^{+3}]$ ion concentration and $[H^+]$ ion concentration); and (b) then adding a restricted amount, preferably less than about 16 mole% relative to the initial quantity of aluminum added, of a metal halide, MX where M=Li, Na, or K and X=Cl, Br, or I, or where MX is a special halide such as beryllium bromide, magnesium bromide, or quaternary ammonium bromide to form a different, stable aluminum cationic plating species.

21 Claims, 3 Drawing Figures

ELECTROPLATING SOLUTIONS FOR THE ELECTRODEPOSITION OF ALUMINUM AND METHOD OF MAKING SAME

CROSS-REFERENCE TO RELATED APPLICATIONS

This application is a continuation-in-part of copending application Ser. No. 734,677 entitled "ELECTROPLATING SOLUTIONS FOR THE ELECTRODEPOSITION OF ALUMINUM, AND METHOD OF MAKING SAME" filed Oct. 21, 1976, Jack Yea Wong, Inventor now abandoned, which application is, in turn, a continuation-in-part of Ser. No. 645,552 (now U.S. Pat. No. 4,003,804) entitled "METHOD OF ELECTROPLATING OF ALUMINUM AND PLATING BATHS THEREFORE" filed Dec. 31, 1975, Jack Yea Wong, Inventor.

BACKGROUND OF THE INVENTION

The present invention relates to the plating of high purity aluminum or its alloys (hereinafter and in the claims, simply termed "aluminum") onto an electrically conductive substrate serving as the cathode in an electrolytic cell.

The electroplating of aluminum has been studied and investigated for over half a century by various workers. Prior art aluminum plating processes have been reviewed in detail in the applicant's parent application, Ser. No. 645,552, now U.S. Pat. No. 4,003,804, issued Jan. 18, 1977, and incorporated herein by this reference. In general, the majority of prior art processes are not feasible for large scale industrial application for a variety of reasons. Some processes are associated with known fire and toxicity hazards; some yield aluminum deposits that are not high purity; some electrolytic baths have normally been unstable; and some are complex and relatively expensive to formulate.

With regard to a recent publication by Peled and Gileadi entitled "The Electrodeposition of Aluminum from Aromatic Hydrocarbons", J. Electrochem. Soc., 123, 15 (1976) and a similar article entitled "Electroplating of Aluminum From Aromatic Hydrocarbons" in Plating 60, 342 (1975) it is stated that excellent aluminum deposits can be obtained from stable baths which employ relatively safe chemicals.

Peled and Gileadi describe a plating bath which requires the presence of 2–3 M aluminum halide and 0.1–1 M alkali halide, an organic non-Lewis base solvent (such as benzene and toluene) and a Lewis base such as ethylbenzene. (A Lewis base is any substance that will donate an electron pair to an electron pair acceptor (Lewis Acid)). Ordinarily, benzene and toluene are not considered to have any Lewis base characteristics for practical purposes; however, as a theoretical matter they do have weak Lewis base characteristics. For purposes of this specification and claims, toluene and benzene are considered as non-Lewis base solvents.

The Peled and Gileadi process appears to have intrinsic drawbacks; thus:

Peled et al.'s plating baths consist of basically four (4) ingredients (while the present process requires three (3) basic ingredients). Thus, in addition to $AlBr_3$, an organic solvent such as benzene or toluene, and an alkali bromide, the Peled et al., bath requires a relatively strong Lewis base such as ethylbenzene, a large aromatic hydrocarbon, or an amine in order to yield acceptable plating. The Lewis base is apparently thought to be required by these inventors to "render the bath insensitive to trace amounts of water or HBr". Also, Lewis bases are considered to be good "bromine getters", and their presence would prevent or retard any deleterious effects of halide or halogen formed during plating by absorbing the by-products of plating. In the present invention, a "bromine-getter" or "halogen-getter" is not required because: (a) neutral solvents inert to halogens such as benzene, tetrahydrofuran, and cyclohexane are used; and (b) the electrolytes of the present process, which contain the by-products of plating, are directed from the zone of plating to a column packed with activated aluminum which regenerates more aluminum cationic plating species and this regenerated electrolyte is then recirculated to the plating zone to replace the aluminum cationic plating species consumed during plating.

At any rate, Peled and Gileadi report that when a single solvent non-Lewis base system such as benzene or toluene, is employed in their plating baths, "a tarlike organic deposit containing no aluminum was formed if benzene was the solvent" and in toluene "a gray to black deposit was produced". They therefore concluded that the addition of a strong Lewis base was essential to a good plating performance. (In stark contrast, the applicant herein has obtained the best quality aluminum deposits, at highest current densities, when a single non-Lewis base solvent system, such as toluene or benzene, is used without the addition of a fourth component as in the case of the above inventors).

Some Lewis bases such as ethylbenzene and naphthalene derivatives are relatively expensive and in scarce supply. Furthermore, the employment of a Lewis base in the plating system substantially increases the resistivity of the bath. Because of such increased resistivity Peled and Gileadi report that in a majority of cases their current densities are only 5 to 10 $mA/cm^2$ at 100% current efficiency. (In the present invention, substantially increased current densities-varying from 35 to 125 $mA/cm^2$ are observed at 100%, or near 100% current efficiency.)

The work of Peled, and Gileadi, cited earlier, used preformed aluminum bromide, as do Capuano and Davenport*. Preformed aluminum bromide is relatively expensive, is in scarce supply, and is difficult to work with because it picks up water readily from the atmosphere. Water readily reacts with the preformed aluminum bromide to form aluminum oxide; thus aluminum is not available for the plating operation. On the other hand, the applicant herein prepares aluminum bromide in complex form in situ, which is relatively safe to employ on a large scale. Furthermore, other aluminum halides such as $AlCl_3$ and $AlI_3$ have also been employed either, by themselves or in mixtures thereof, in some baths of the present invention (see Table I).

* See Capuano and Davenport, Canadian Pat. No. 945,935 and U.S. Pat. No. 3,775,260

With further regard to the Mathers et al. work, exemplified by U.S. Pat. No. 2,170,375 issued Aug. 22, 1939 and The Electrochemical Society, Pre-Print 65–2, published Apr. 30, 1934, pp. 25–38, the Mathers electrolyte of $AlBr_3$-Ethyl Bromide-Benzene forms an ethyl aluminum bromide cation plating complex ($[EtAl_2\ Br_5]^+$, which is formed spontaneously between $AlBr_3$ and Ethyl Bromide (or other alkyl halides). The Peled and Gileadi developments, discussed above, also produces a similar plating complex between a Lewis base such as ethylbenzene and $AlBr_3$. In both the Mathers and Gileadi electrolytes, low current densities result and the electrolytes are non-regeneratable. The solvents, such as benzene and toluene, do not form part of the plating complex.

The electrolytes formed by means of the present invention differ substantially in concept from those of Gileadi and Mathers in producing a different plating complex which incorporates the solvent itself. The electrolytes of this invention require, initially, the presence of hydrogen halide to form the particular plating complex. However, the presence of the hydrogen halide must be carefully restricted to low limits after the plating complexes have been formed in order to accomplish the overall plating results desired by the applicant.

The resulting electrolytes of this invention are not only regeneratable but permit higher current densities and greater throwing power than those of Gileadi and Mathers. In addition, cathode efficiency and plating quality are superior to these prior art electrolytes. Furthermore, compared to prior art processes known up to the present time, this invention provides the most economical and relatively-safe-to-employ method to electrodeposit high quality aluminum on a large scale. The electrolytes of the present invention are the most thermodynamically stable yet.

SUMMARY OF THE INVENTION

Aluminum (or an alloy thereof) is electroplated upon electrically conductive substrates by immersing the substrate as a cathode in stable electrolytes, which comprises the steps, basically of:

(a) reacting a given quantity of aluminum with a hydrogen halide such as HCl, HBr, or HI (but preferably hydrogen bromide) or reacting aluminum with a halogen such as $Cl_2$, $Br_2$ or $I_2$ (but preferably bromide) and hydrogen halide, in the absence of water, but in one of the following single solvents or mixtures thereof: benzene, toluene, carbon disulfide, cyclohexane, dimethyl sulfide, tetrahydrofuran, diiodoethane, toluene-cyclohexane (1:1), benzene, cyclohexane (1:1), THF: benzene (4:1) and toluene-$CS_2$ (3:1) to form an intermediate aluminum halide cation in solution, the concentration of the aluminum cation and the concentration of hydrogen ion, in solution being, respectively, below 5.0 M and 0.4 M and preferably having an aluminum cation concentration ranging between about 2.7 M and 4.2 M and a maximum allowable hydrogen ion concentration ranging between 0.01 M and about 0.3 M, the maximum allowable amount of $[H^+]$ depending upon the aluminum cation concentration; there is a direct, substantially linear, relationship between the aluminum ion concentration and the hydrogen ion concentration and this linear relationship appears to be: $y=5.27X+2.6173$, where y=aluminum cation molarity and X=maximum hydrogen ion molarity. The maximum allowable hydrogen ion concentration is thus seen to be about 0.3 M when the maximum preferred aluminum cation concentration is 4.2 M, and the maximum allowable hydrogen ion concentration decreases to about 0.0 1 M when the minimum aluminum cation concentration is about 2.67 M.

(b) The second main reaction step requires the addition to the solution of (a) above, of about 0.5–16 mole%, relative to the initial amount of aluminum added, of alkali metal halide, MX, where M=Li, Na, or K and X=Cl, Br, or I; or where MX is a special halide such as beryllium, bromide, magnesium bromide, or quaternary ammonium bromide to form a different, stable aluminum cationic plating species.

The novel electrolyte, thus formed, is then directed to a plating chamber, utilized in the plating chamber until it is aluminum ion poor, and transferred to a regeneration chamber, filtered, and returned to the plating chamber for further plating operations.

It has been found that some hydrogen bromide is required for formation of the aluminum cationic plating species (as will be explained in detail hereafter); however, both the hydrogen ion and MX concentrations are highly restricted in order that no competing plating reactions occur, (e.g., to avoid plating of M or evolution of $H_2$).

It is possible to place aluminum, hydrogen halide (or a halogen and hydrogen halide) and MX, into a reaction zone, simultaneously, to produce a stable, aluminum cationic plating species but this is not presently preferred. It is also possible to place an aluminum-M alloy (where M is equivalent to the metal in MX) and hydrogen halide or the aluminum alloy plus halogen and hydrogen halide, into a reaction zone, simultaneously, to produce the same stable plating species.

The electroplating solutions, and process of this invention have the following characteristics:

(1) by the elimination of a volatile substance—hydrogen bromide gas, as the dominant conducting species in the bath, and the substitution, therefor, of 0.5–16 mole% (relative to the initial amount of aluminum added) solid alkali metal halide, beryllium bromide, magnesium bromide, or a quaternary ammonium bromide salt, together with a low resistivity solvent system, the resulting plating baths are rendered stable and highly conductive, indefinitely, provided oxygen and water vapor are excluded;

(2) the ability to make use of a readily available major solvent, toluene, as the single solvent and also the use of more stable organic solvents, in particular, single solvent systems such as benzene, tetrahydrofuran, dimethyl sulfide, and cyclohexane that are relatively inert to attack by plating by-products;

(3) the used electroplating solution of this invention can be transferred from the zone of plating to a regeneration column packed with fine aluminum, which filters off plating byproducts such as bromide and permits the electroplating solution to have a substantially longer life;

(4) the employment of a mechanical mask as the cathodic substrate, which permits the electrodeposition of aluminum in controlled patterns on the substrate; and (5) the ability to use aluminum anodes in addition to inert anodes such as porous or solid graphite, tantalum, and platinum.

EMBODIMENT OF THE INVENTION

(A) Introduction

Figure 1:
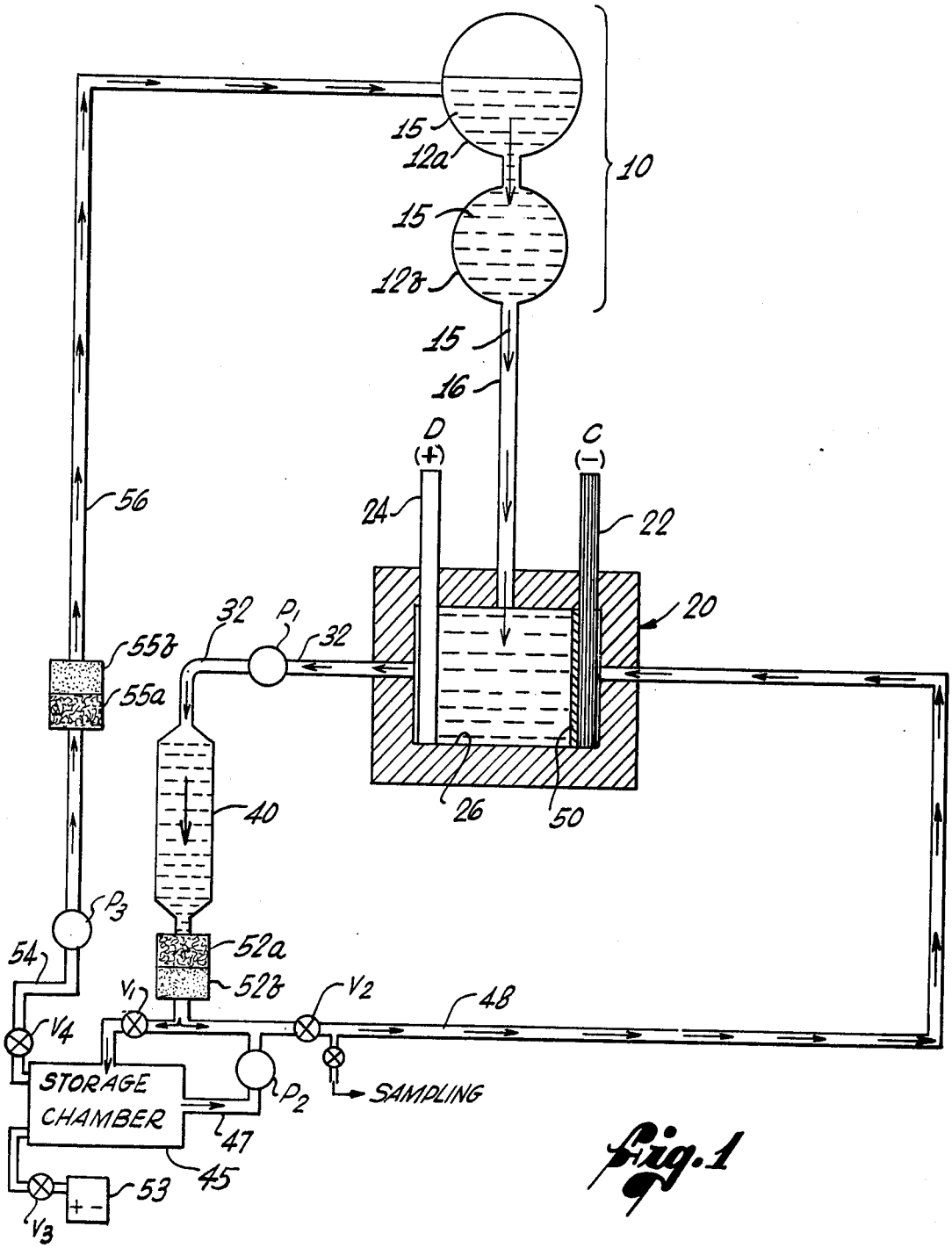
FIG. 1 is a schematic representation of the processing system utilized in this invention.

It is a primary object of the present invention to provide an improved, long life electrolyte for the electrodeposition of high purity aluminum. Another object of the present invention is to provide a novel electroplating bath which is stable to moisture, inexpensive, and easy to prepare and control, thereby providing a commercially feasible aluminum plating system. A still further object is to provide a bath for the electroplating of aluminum, which has a relatively high electrical conductivity, low voltage requirements and in which high electrode efficiences are obtainable.

A still further object is to provide a generalized electroplating process which can be modified and broadened for other industrial applications.

Although the invention described in parent application Ser. No. 645,552 also relates to the electrodeposition of aluminum from two relatively inexpensive, conductive stable organic electrolytes to produce a bright, adherent, ductile deposit of high purity aluminum, and these electrolytes are feasible for industrial application, further improvements in the electrolytic system are set forth herein.

In Ser. No. 645,552, both the Toluene-Hydrogen Bromide-Aluminum Bromide and Ethyl Bromide-Toluene-Hydrogen Bromide-Aluminum Bromide Systems use toluene as the primary solvent. Since in these systems for every aluminum atom deposited, three ions of bromie are released, as byproducts, the plating baths eventually build up a high concentration of bromine and bromide ions. Since toluene is also a mild "bromide-getter", the following side reaction can occur:

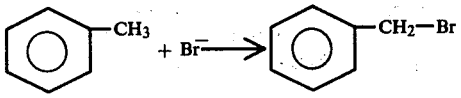

(I)

Thus, eventually the electrolyte becomes very viscous, the current densities decrease, the throwing power decreases; and the electrolyte finally yields black deposits of aluminum. However, in the present invention, the use of toluene may be entirely avoided, if desired, and the preferred solvents used are benzene, tetrahydrofuran, dimethyl sulfide, cyclohexane, and carbon disulfide which are relatively inert to attack by the by-products by plating.

It has also been found, in using both the Toluene-Hydrogen Bromide-Aluminum Bromide and Ethyl Bromide-Toluene-Hydrogen Bromide-Aluminum Bromide Systems of said parent application, Ser. No. 645,552 that both these plating systems depend on hydrogen bromide as the major conductivity ingredient of the electrolye. Since hydrogen bromide gas itself is relatively volatile, the hydrogen ion concentration end point of the electrolyte, which affects the plating quality and throwing power of the electrolyte, is somewhat difficult to maintain or equilibriate during long periods of electroplating. In other words, as the conductivity of these electrolytes change during plating so will the electrode efficiences, throwing power of the electrolyte, and ultimately the plating quality also changes. Furthermore, the stability of the plating hydroaluminum bromide complex of Ser. No. 645,552, $[Al_2\ Br_4\ H{\cdot}ArH]+$, can be improved (although it is adequate for high quality plating) by the substitution of the hydrogen bromide gas with a restricted amount of a stable solid salt, MX, (where M=Li, Na, K and X=Cl, Br, i; or special bromides such as $BeBr_2$, $MgBr_2$ and $NH_4$ Br), to form the major conductivity species in the electrolyte.

Another innovation of the present invention is that as soon as the by-products of plating (halogens or halides) are released during plating, they are immediately directed by a mechanical pump (or by gravity, in some instances) from the zone of plating to a regeneration column packed with fine, activated aluminum which absorbs the by-products. The halogens or halides are allowed to react with the fine, activated, aluminum to regenerate more aluminum halide plating species, which is then available for replacement of the aluminum halide ions consumed in the plating process.

Hence, the present invention is a balanced cycle in which the amount of aluminum consumed during plating theoretically equals the amount of aluminum dissolved, provided that factors such as oxygen, water vapor, and solvent evaporation are controlled. Such column treatment re-establishes the equilibrium altered during plating.

(B) Electroplating Solution Formation, Chemistry, and Electroplating Process The electroplating solutions of this invention are formed in the following manner.

A given quantity of pure aluminum, or an alloy of aluminum, is reacted with hydrogen halide, or a halogen, in the presence of an organic, substantially anhydrous, non-Lewis base solvent, previously generally described, and in the absence of oxygen. The reaction commences at room temperature but the heat of reaction increases the temperature on the order of about 30° C. After the reaction equilibrium, substantially all of the aluminum is in solution as a complex cationic species, as will be later described.

The initial amount of aluminum entering into the reaction is such that the final aluminum ion $[Al^{+3}]$ molarity, at equilibrium, is below 7.5 M and should be below 5.0 M and preferably lies between 2.7 and 4.2 M. The higher the $Al^{+3}$ ion concentration, the higher the resistivity of the ultimate plating solution, and for this reason, aluminum ion concentrations of between 2.7 M and 4.2 M are much preferred for commercial plating operations.

The amount of hydrogen halide added to the reaction vessel or zone, is in excess of that required to produce an aluminum halide e.g., 3:1 molar ratio of HBr: aluminum to produce $Al_2Br_6$. The aluminum cationic species formed in the reaction appears to be a complex aluminum cationic species (see Equation II) infra) rather than simply an aluminum halide. But the reaction, nevertheless, requires at least that quantity of hydrogen halide sufficient to produce an aluminum halide plus a small additional quantity of hydrogen halide as a catalyst for the formation of the aluminum cationic plating species, as will be set out in greater detail hereafter. However, the excess amount of any hydrogen bromide remaining, after equilibration, cannot be so large as to result in a final $[H^+]$ ion concentration which is above the maximum amount permitted by the relationship shown in FIG. 3.

Figure 3:
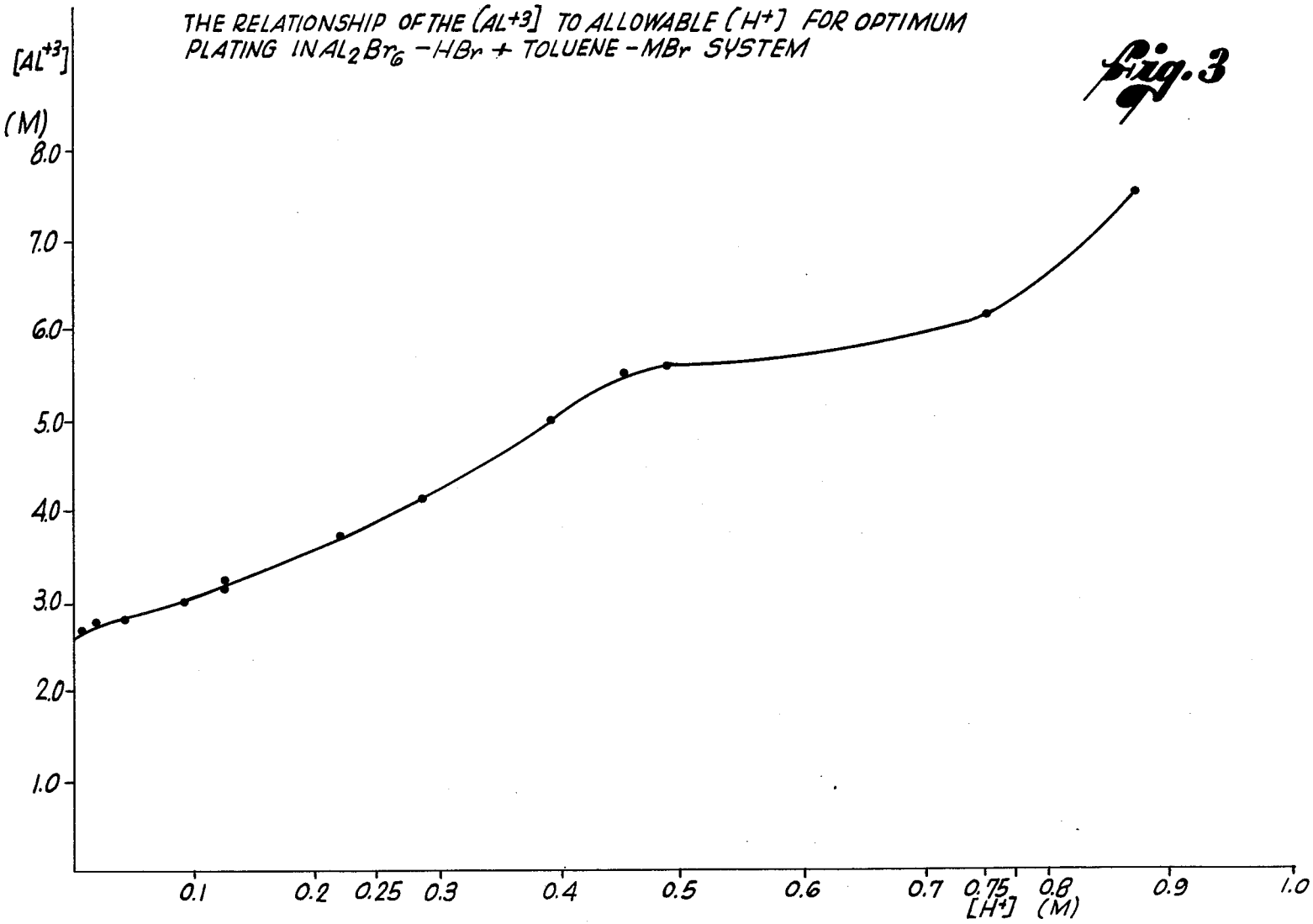
FIG. 3 is a graph showing the relationship of the $[Al^{+3}]$ cationic species to allowable $[H^+]$ ion for optimum plating in a particular electrolyte of this invention.

With reference to FIG. 3, it will be noted that the relationship of $[Al^{+3}]$ concentration to $[H^+]$ ion concentration is a direct (rather than inverse), substantially linear, relationship and appears to follow the mathematical expression $y=5.27\ X+2.6173$ where y equals aluminum cation molarity and X=hydrogen ion molarity.

The maximum hydrogen ion concentration is thus seen to be about 0.4 M $[H^+]$ where the $[Al^{+3}]$ concentration is 5.0 M; about 0.3 M $[H^+]$ where the $[Al^{+3}]$ concentration is 4.2 M; and about 0.01 M when the $[Al^{+3}]$ concentration is about 2.76 M. (While FIG. 3 relates to a particular electrolytic system of $Al_2Br_6$-HBr-Toluene-MBr, the $[Al^{+3}]$ to $[H^+]$ ion relationships shown are substantially the same for other Aluminum halide-hydrogen halide-non-Lewis base solvent-metal halide electrolytes).

In the case of the use of halogen to form the aluminum halide a slight excess over 3:1 halogen to aluminum is first employed to produce $Al_2Br_6$. Then a slight addition of a hydrogen halide is made in accordance with the parameters dictated by the FIG. 3 relationships.

In any event, the $[H^+]$ ion concentration is preferably kept as low as possible, once the plating complex has been formed, to prevent hydrogen formation at the cathode or other side reactions and preferably the $[H^+]$ ion concentration should be kept below 0.1 M and even as low as 0.01 M, if possible, even when the $[Al^{+3}]$ concentration lies above 4.2 M and approaches the higher limits of the order of 5.0 M or 6.0 M.

A restricted amount of a metallic halide (MX) is then added to the equilibriated solution above-described. The metallic halide is selected from the halides of Lithium, Sodium, Potassium, Beryllium, Magnesium, and Ammonium ions. The amount of MK added is preferably below 16 mole %, relative to the initial molar amount of aluminum entering the reaction and lies preferably between 0.5–16 mole %. Thus, if 7 moles of aluminum are placed into the reaction, the resulting solution, after all reactions have taken place, and equilibrium has been reached, may equal 2 liters, in which case a 3.5 molar[Al+3] ion concentration is present. However, a 10 mole % addition of MX based on the initial molar amount of aluminum would equal a 0.7 mole MX addition. Concentrations above about 16 mole % MX, relative to initial aluminum present in solution, create a non-aluminum plating solution, since other reactions appear to be taking place involving deposition of the $M^+$ ion.

While it is preferred that the aluminum halide species be entirely formed prior to addition of MX, it is feasible to introduce aluminum, the hydrogen halide or halogen, and the MX simultaneously into solution, and have an operable electroplating solution. The stepwise reaction procedure, above-described, is presently preferred because the MX appears to be dissolved faster in the presence of the first-formed aluminum halide cationic species.

The reaction of hydrogen halide with aluminum appears to generate aluminum halide, in complex form, in situ, (see Equation (II) below):

$$2\ Al+ArH+6H \xrightarrow[HX]{} [Al_2X_5.ArH]^+ + X^- + 3H_2 \qquad \text{(II)}$$

wherein ArH is benzene, toluene, THF, dimethyl sulfide, diiodoethane, cyclohexane, or $CX_2$ but preferably benzene or toluene; X is chloride, bromide, or iodide but preferably bromide; $[Al_2X_5.ArH]^+$ is a complex cation. It appears that part of the ArH, e.g., benzene is complexed with $Al_2X_5$ with the HX acting as a catalyst, and the remaining ArH acting only as a solvent.

In the parent patent application, Ser. No. 645,552, hydrogen halide also serves a second function—that of being the major conductivity species in solution.

Halogen may also be reacted with aluminum in the presence of hydrogen halide (and in place of hydrogen halide alone) to form aluminum halide in complex form in situ, as shown below in Equation (IIIa) and (IIIb):

$$2Al+3X_2 \rightarrow 2AlX_3 \qquad \text{(IIa)}$$

$$2AlX_3+ArH \xrightarrow{HX} [Al_2X_5.ArH]^+ + X^- \qquad \text{(IIIb)}$$

wherein X is chloride, bromide, or iodide.

Again, here the HX acts as a catalyst to cause formation of the complex plating species of aluminum ion with non-Lewis base solvent such as benzene and toluene.

The plating complex, formed in Equation (II) or Equation (IIIb), viz. $[Al_2X_5.ArH]^+$ is then reacted with MX to form a more stable plating species, as set forth in Equation (IV) below—again in the presence of HX acting as a catalyst.

$$MX+[Al_2X_5.ArH]^+ \xrightarrow{HX} [Al_2X_4M.ArH]^+ + X_2 \qquad \text{(IV)}$$

wherein MX is an ionic (metal) halide, and $M=Li^+, Na^+, K^+, Be^{++}, Mg^{++}, NH^+_4$, $X=Cl^-, Br^-, I^-$; and $[Al_2X_4M.ArH]^+$ is a metal $\pi$-complex cation*.

*$\pi$—complex cation=a plating complex cation.

It has been found that optimal plating is achieved if the ionic (metal) halide salt is added after the complex aluminum halide has been formed in situ, as mentioned previously.

The unreacted metal halides in solution serve two (2) functions: (i) to increase the conductivity of the solution; and (ii) to improve the throwing power of the bath. These MX salts appear to combine with uncomplexed aluminum halide to produce in ionic form:

$$MX+Al_2X_6 \rightarrow Al_2X_7^{(-)}+M^{(+)} \qquad \text{(V)}$$

The just-referred to substantially anhydrous plating solution, containing $\pi$-complex cations, which is prepared in a reaction vessel or zone, is then directed to an electrolytic or plating cell in which aluminum is electrodeposited on an electrically conducting cathodic substrate.

Referring to FIG. 1, the reaction zone 10 includes one or more reactors 12 in which the basic reagents aluminum, a halide source, and MX have been thoroughly mixed and reacted, as above-described to form the fresh electrolyte 15 of this invention. The fresh electrolyte 15 is then transferred, by suitable and conventional means, e.g., a pump (not shown) via line 16 into an electrolytic cell 20.

The cathode 22 of cell 20 may comprise any electrically conductive material upon which aluminum is to be plated. However, the preferred cathode 22 is a metallic substrate. As mentioned previously, the preferred anode 24 is the aluminum anode although inert anodes may be used with excellent results.

The plating chamber 26 of cell 20 is basically an enclosed area that contains the anode and cathode separated at distances of from about 0.030 inch to about 1.000 inch. The electrolyte 15 enters the chamber 26 from the reaction zone(s) **12*a*, 12*b* via line 16. The used or spent electrolyte is preferably continuously withdrawn from the plating chamber 26 by pump $P_1$ after the aluminum cationic plating species has been depleted to some small extent and is then fed via line 32 to a regeneration column 40**, packed with fine, activated aluminum*. The aluminum cation plating species (see Equations (IIIa), (IIIb), (IV), and (VI) (below) is thereby replenished or enriched, in the presence of $HX+X_3^-$ or $X^-$ already in the electrolyte:

$$2\,Al + ArH + 2X_3^- \xrightarrow[X_3^-X^-]{HX} [Al_2X_5 . ArH]^+ + X^- \quad (VI)$$

* Activated aluminum is prepared by degreasing 99.9% pure aluminum with a toluene-hexane admixture, washing with KOH, rinsing with water and methanol, and washing in the final solvent used as the reaction solvent.

After passage through the regeneration column 40, the enriched electrolyte may be filtered, e.g., in a combination filter comprising a woven glass bed 52*a*, and a sand bed 52*b*, to remove any suspended aluminum and other contaminants, such as polymers and preferably returned directly to the plating chamber 26 via line 48. If it is desired to introduce some additional fresh electroplating solution from reactors 12*a* and 12*b*, some enriched electrolyte may be held in storage chamber 45 for return to plating chamber 26 by means of pump $P_2$ via lines 47, 48 when required.

Valves $V_1$ and $V_2$ are placed in appropriate lines, as shown, to direct the enriched solution, as desired. The sampling of enriched electroplating solution, to check increased $[Al^{+3}]$ molarity and/or resistivity, occurs by taking samples, from return line 48.

By following the above procedure, the by-products of plating (halogen and halide) will not accumulate in such large concentrations in the plating chamber 26 such that they will attack either the plated aluminum 50, on the cathode 22 or the solvent (if toluene is used). Thus, as aluminum is being plated onto the cathode 22, the released by-products of plating are directed away from the cathode 22 towards the anode 24 such that some of the by-products react with the (aluminum-)anode 24 to form new aluminum cation plating species while the remainder of the by-products are trapped by the regenerating column 40 in which the by-products are re-converted to new aluminum cation plating species, thereby replenishing or enriching the solution (see equations III, IV, and VI).

Although the electroplating process described, to this point, is a balanced cycle in which theoretically at least the electrolyte is stable indefinitely and electroplating can be performed indefinitely, the electrolyte may tend to deteriorate after long periods of continuous plating because of the following considerations:

(a) Evaporation of solvent can occur. Such evaporation will increase the viscosity of the electrolyte and lower its conductivity. As this happens, the electrolyte 15 in the plating chamber 26 gets heated during plating, which increases the probability of attack of solvent by the plating by-products;

(b) Some water and oxygen from the air may get into the process cycle; which produces contaminants such as $Al_2O_3$, $Al_2(OH)_3$, etc.; and (c) The rate of plating is more rapid than the rate of reaction of the by-products of plating with aluminum to form new aluminum cationic plating species. Eventually some by-products pass through both the aluminum anode 24 and regeneration column 40 unaltered such that these by-products would eventually concentrate to such high levels that the equilibrium of the electrolyte is altered.

Thus, after long periods of plating, it is presently preferred to incorporate into the process system, above-described, a recirculation of high viscosity, high resistivity electrolyte to reaction vessel(s) 12*a*, 12*b*. This is accomplished by sending deteriorating electrolyte to storage chamber 45 from regenerating bed 40.

More specifically, in response to an appropriate signal from a conductivity probe 53, indicating a high given resistivity (e.g., above 400 ohm/cm) in the electrolyte in storage chamber 45, the electrolyte will be pumped, via pump $P_3$ through open valve $V_4$ and line 54, to a combination filtration bed 55*a*, 55*b* of the same type as filtration bed 52*a*, 52*b*. The high resistivity electrolyte is then sent to reaction zone 12*a* after filtration, via line 56 and treated with fresh solvent, aluminum, MX, and hydrogen halide to synthesize new aluminum cation plating species. After the electrolyte has fully been synthesized, it is again transferred to the cell 20 to enter the plating cycle once again. Alternatively, of course, the deteriorating electrolyte could be discharged from the plating cycle or system, entirely and completely fresh electroplating solution be made.

C. The Solvents

The particular solvent employed is preferably one in which the cationic aluminum bromide and hydroaluminum bromide cations are relatively soluble, and which does not contain groups which would provide competing reactions in the system. It has been found that the following solvents may be employed: benzene, toluene, tetrahydrofuran (THF), cyclohexane, dimethyl sulfide, diiodoethane and carbon disulfide. All of the solvents are organic, substantially anhydrous, non-Lewis base solvents. Although it will be seen from the specific examples presented hereinafter that a wide range of mixtures of the above solvents provide satisfactory aluminum deposits, a single solvent system is preferred.

In general, a single solvent system is the least expensive and most convenient solvent due to its relatively low viscosity. It is preferable to maintain the viscosity at relatively low levels to avoid mechanical problems of pumping the solution; and low viscosity solutions produce the best current densities. Furthermore, single solvent systems normally afford superior aluminum deposits than solvent mixtures. Thus, the concentration of aluminum bromide in solution should be from about 2.7 M to about 5.0 M and optimally, between about 2.7 M to 4.2 M. The use of benzene and toluene solvents is preferred especially the former is relatively inert to attack from plating by-products. Cyclohexane is inert to attack from plating by-products, but the solubility of aluminum bromide and ionic halide is not as great in cyclohexane as in benzene and toluene. Carbon disulfide is the least desirable of the single solvents because it not only has a pungent, foul odor, but also the resulting $CS_2$ electrolyte is relatively viscous.

(D) The Halide Source

The preferable halide is bromide because hydrogen chloride as the reactant with aluminum to form aluminum chloride is relatively insoluble in organic solvents, such as benzene, toluene, and cyclohexane, with a few exceptions such as THF, dimethyl sulfide and carbon disulfide. Hydrogen iodide is acceptable except that the resulting aluminum iodide in situ is more viscous than aluminum bromide. It should be pointed out that a wide range of mixtures of the above aluminum halides provide satisfactory results, but a single aluminum halide is preferred in all instances (see Tables I and II).

(E) The MX Salts

The amount of ionic halide salts, MX, that is added is dependent on the initial concentration of aluminum added. One might surmise that the upper limit of ionic salt concentration should not exceed the molar ratio of $MX:AlX_3$ (1:2) corresponding to the formation of $Al_2X_7{-}M^{(+)}$. However, it has been discovered that too high a concentration of these MX species in solution appears to prevent plating of aluminum, whereas a moderately high concentration of MX causes the incorporation of these salts in the electrodeposit along with aluminum. To prevent such effects, it has been found that the concentrations of MX should, preferably, be from about 0.5 to 16 mole % relative to the quantity of aluminum initially added.

The types of ionic halide salts, MX, that are useful for the present invention must contain two criteria: (a) the radii of the cations are relatively small in order to allow the ions to transfer from one complex to another in a viscous solution. Thus, cations from Group I and Group II elements of the Periodic Table such as $Li^+$, $NA^+$, $K^+$, $Be^{++}$, $Mg^{++}$, and a special case, $NH_4^+$, all fit the first criteria; (b) the ionic salts, MX, must have sufficiently high ionization potentials compared to aluminum such that the salts would not easily codeposit along with the aluminum. Thus, salts of heavy metals such as copper and iron, interfere with the plating of aluminum. It is always easier to electroplate copper and iron than aluminum.

The halide, X, of the MX used may be a chloride, bromide, or iodide. However, in general, the halide should be the same halide as that of the aluminum halide used at the time for the purpose of simplicity—and also to eliminate possible contaminants. It has been found that the addition of halides of $Li^+$, $Na^+$, $K^+$, $Be^{++}$, $Mg^{++}$, and $NH_4^+$ gives indistinguishable results, although the preferred metal halide is potassium bromide. For the purposes of this specification and claims, the $NH_4^+$ ion will be defined as a metallic ion.

(F) The Optimal Solutions and Process Considerations

Hence, the optimal plating solution of the present invention contains the following parameters:

(1) The final aluminum bromide concentration is from about 2.7 M to about 4.2 M, and the hydrogen ion concentration ranges between about 0.1 M and 0.3 M, the maximum allowable hydrogen ion concentration bearing a direct, substantially linear, relationship to the aluminum cation concentration, this relationship following the expression $y=5.27\ X+2.6173$ where y=aluminum cation (M) and X=maximum hydrogen ion molarity;

(2) The preferably metallic halide salt is potassium bromide; its concentration in solution preferably lies in the range of from about 0.5 to about 16 mole% relative to the initial concentration of aluminum in solution;

(3) Benzene and toluene are the presently preferred non-Lewis base solvents with benzene being the solvent of choice;

(4) The resistivity of the plating solution is from about 100 to 400 ohm centimeters;

(5) The best cathode efficiency observed is 100%; and (6) The best current density is about 125 milliamperes per square centimeter.

The optimum electrolytes of this invention have been found to be still active even after one week of continuous, non-stop electroplating. The freshly made electrolyte is from dark orange to chocolate-brown in color. However, after exposure to light the color turns black.

When a solution of the foregoing type is then directed to the electroplating cell 20 of FIG. 1, the following reactions may occur at the cathode 22:

$$[Al_2Br_4K.ArH]^+ + 3e^- \rightarrow 2Al + ArH + KBr + 3Br^- \quad \text{(VII)}$$

$$7Al_2Br_6 + 6e^- \rightarrow 2Al + 6Al_2Br^-_7 \quad \text{(VIII)}$$

The aluminum plated onto cathode 22 is designated by the numeral 50.

At the anode 24, the following reaction may occur if toluene is the solvent and the anode used is an inert anode:

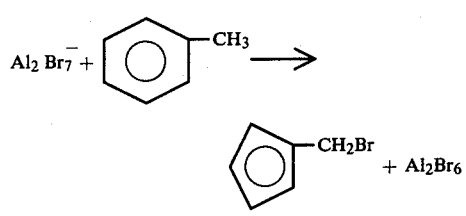

(IX)

However, if an aluminum anode is used and the solvent used is one of benzene, cyclohexane, THF, or $CS_2$, the only reaction that occurs is the slow dissolution of the aluminum anode by the by-products of plating, which replenishes the aluminum bromide consumed during plating. (See Equations III and VI).

Before plating, the cathode is degreased with methanol, etched in an acid mixture consisting of 25% $H_2O$, 25% $H_3PO_4$, 25% $HNO_3$, and 25% $CH_3COOH$, washed in distilled water, rinsed in methanol and dried. For alloy-42 and steel surfaces, the cathodes are treated with sandpaper, etched in 2 N HCl, washed with distilled water, rinsed with methanol, and dried.

It has been found that the plating baths herein described plate effectively at voltage drops of from about 1.6 to about 3.0 volts, when the cathode and anode are separated at distances of from 0.030 inch to 0.050 inch. Under these conditions for a 10 minute plating, the maximum thickness of plating is about 500 micro inches. Voltages of up to about 5.0 volts may be required when cathode and anode are spaced further apart, e.g., up to about a 1 inch spacing.

Figure 2:
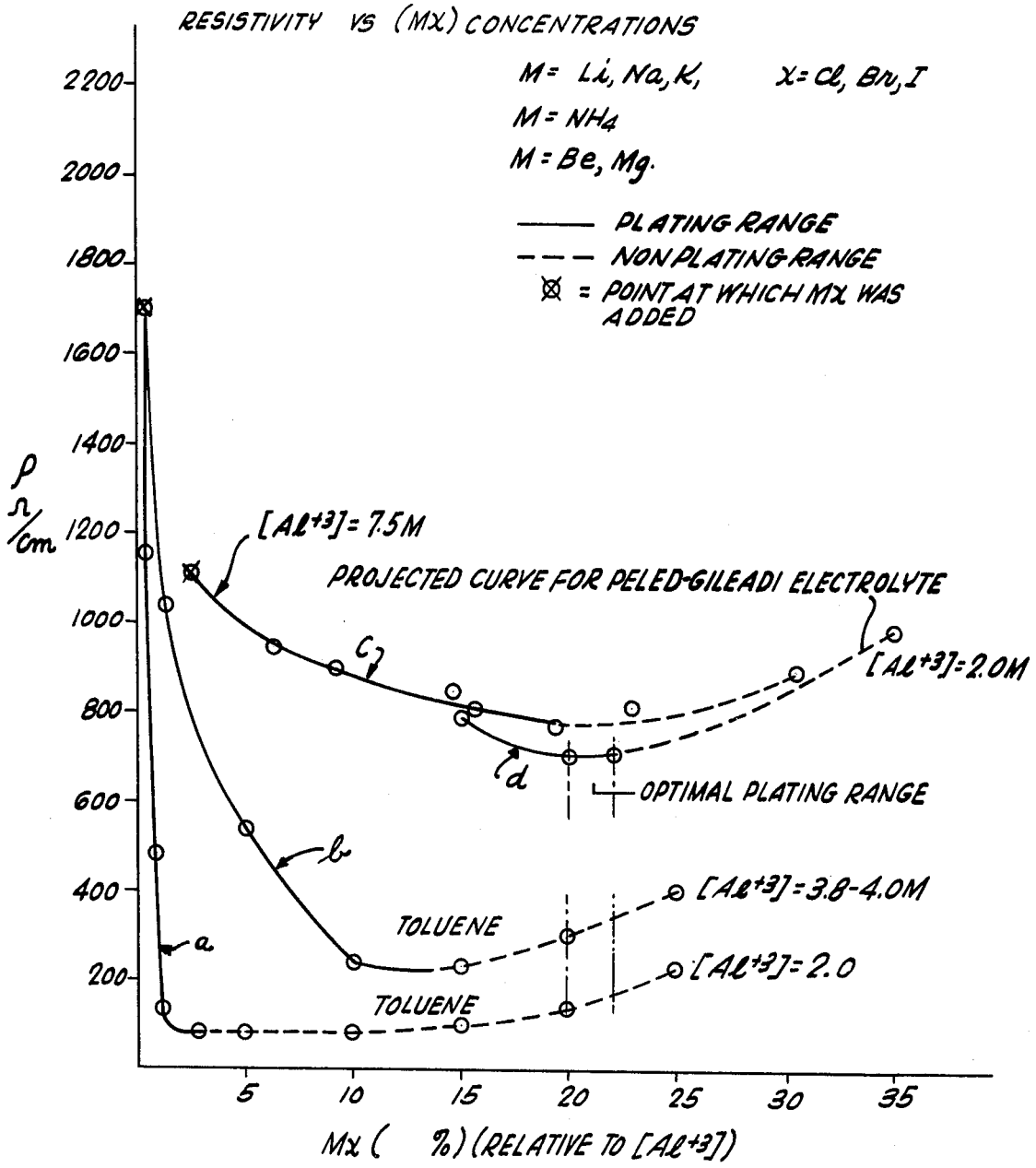
FIG. 2 is a graph of resistivity of various electrolytes utilized in this invention and by others vs. concentration of alkali halide (MX), relative to the initial quantity of aluminum added.

Referring now to FIG. 2, a plot of various plating solutions vs MX concentration is shown. Curves a, b, and c are plots of plating solutions of this invention, containing 2.0 molar, 3.8–4.0 molar and about 7.5 molar $[Al^{+3}]$ concentrations, in toluene, respectively, and containing varying amounts of MX, relative to the initial $[Al^{+3}]$ added to the plating solution. Curve d is a similar type of plot for a Peled-Gileadi plating bath containing 2:1 molar ratio of toluene to ethylbenzene, and a 2.0 molar $[Al^{+3}]$ concentration.

The preferable plating solutions of curves a and b are those which have resistivities of from between about 100–400 ohm/cm. and which utilize initial $[Al^{+3}]$ concentrations of below about 4.0 molar and between 0.5–16 mole % MX, relative to the initial $[Al^{+3}]$ concentration. These plating solutions have substantially lower resistivity than the Peled-Gileadi plating solution, curve d, (which for a 2.0 molar initial $[Al^{+3}]$ has an optimum resistivity of approximately 700 ohm/cm). In the case of applicant's curve c, the optimum resistivity is also high (about 800 ohm/cm) but it should be borne in mind that this solution contains an initial very high (7.5 molar) $[Al^{+3}]$ concentration and does not contain a Lewis base. The optimal MX concentration, for curve d, is about 16–20 mole %, relative to initial $[Al^{+3}]$ concentration. From the foregoing, it will be seen that initial $[Al^{+3}]$ concentrations of as high as 7.5 Molar and as high as 20 mole % MX may be utilized, if one does not object to high solution resistivity of about 700–800 ohm/cm. and consequent high current density. It is presently highly preferred to work with those portions of curves a and b, and solutions falling between these curves, which have resistivities of the order of 100–400 ohm/centimeter, initial $[Al^{+3}]$ molar concentrations of below about 4.2 molar, and MX concentrations of between about 0.5–16 mole percent.

(G) Controlled Aluminum Deposition

Electrodeposition of aluminum in controlled patterns is accomplished by employing a mechanical mask. This plating method is also referred to as "spot-plating". By placing a mechanical mask over the cathode, the cathode areas covered by the mask will not be plated while the cathode areas not covered by the mask will be electroplated with aluminum. This electrodeposition of aluminum in controlled patterns is possible for aluminum but fails for other elements such as Cu and Fe because organic electrolytes of aluminum have much smaller current densities and throwing power compared to aqueous electrolytes of the majority of elements. The electrodeposition of aluminum usually proceeds via line of sight of plating, i.e., it is only possible to plate onto uncovered areas of the cathode directly facing the anode. Thus, in the case of elements such as Fe, Cu and Ag, there is usually plating on areas underneath the mechanical mask as well as on the "backside" of the cathode, i.e., the side of the cathode that is not facing the anode.

Suitable materials for mechanical masks must contain two criteria: (i) they are electrically non-conductive while at the same time are hard and capable of being cut into thin sheets; (ii) they are chemically inert to attack by the organic electrolytes of aluminum. It has been discovered that Teflon®, polyphenolic materials, polyfluoroethylpropyl materials (FEP), and polyvinylchloride provide excellent masking materials in the electrodeposition of aluminum in controlled patterns.

(H) Anode Considerations

It has been found in Ser. No. 645,552 that high purity aluminum can be electrodeposited when inert anodes such as porous and solid graphites, tantalum, or platinum are used. However, with regard to porous and solid graphite, it has been discovered that only fresh graphite anodes yield excellent plating. As time passes, the plating efficiences and qualities decline progressively. The electrolytes slowly attack the anode during plating. Eventually, an organic polymeric film is formed over the anode at the zone of plating, which increases the resistance of the anode. Another disadvantage of the graphite anodes is that after a plating run the anodes cannot be regenerated and stored for future use; they have to be discarded. In the case of tantalum and platinum anodes, although they can be reused indefinitely, they must be cleaned after each plating run since an organic film is deposited on the anode, which also increases the resistance of the anode. On the other hand, the present invention incorporates an aluminum anode, principally, although the inert anodes cited above can also be used.

The main advantage of aluminum anodes over the inert anodes is that as the concentration of the plating by-products increase, these by-products will attack the aluminum anode, instead of the solvent, causing anodic dissolution. Hence, the equilibrium of the plating species in the electrolyte is maintained, which permits the electrolyte to have a longer life. Another advantage of the aluminum anode over graphite anodes is that the aluminum anode can be re-used as it is not totally dissolved. But, eventually, the aluminum anode will need to be replaced.

(I) Other Process Considerations

While, as stated, it is presently preferred to recirculate electroplating solution, from cell 20, to the regeneration column 40, filters 52, **52*b*, and return to the cell 20, via line 48, on a continuous basis, regeneration and recirculation could also be accomplished after a given period of plating, e.g., 10 minutes, 1 hour, 10 hours, etc. has taken place within cell 20. In any event, the aluminum ion molarity (and/or resistivity) of the electroplating solution, within cell 20**,l, will measurably change after even a very short plating run, and will result in an aluminum cation poor solution relative to that of the initial fresh or enriched electroplating solution.

It will be understood that the process herein contemplated may be employed with aluminum halide cationic plating species, or with aluminum cationic plating species other than those specifically set forth here by way of example.

(J) Experimental Section and Examples (i) Introduction

The conductance and resistivity of the electrolytes were determined by using a YSI-1095 Platinum Conductivity Cell (Cell K=1.0).

In the analyses of the $[Al^{+3}]$ and $[Br^{-}]$ concentrations of the electrolytes, the following procedures were followed: In general, one ml. of electrolyte was decomposed into 2,500 ml. of distilled water using a pressure equalizing funnel and flask. The bromide concentration is determined directly using a bromide electrode (Orion Model 94035A) and an Orion pH meter, which gave readings in millivolts. By means of a standard bromide calibration curve and extrapolation, the millivolt readings were converted into molar concentrations. $[Al^{+3}]$ concentrations were determined by titrating an aqueous solution of the electrolyte (1 ml. electrolyte/100 ml $H_2O$) with a standard sodium hydroxide solution up to the end point pH of 11.00. Analyses for $[Cl^{-}]$ and $[I^{-}]$ concentrations were identical to that of the $[Br^{-}]$.

To test the plating quality of a particular electrolyte an experimental plating assembly was set up as illustrated in FIG. 1.

For the electrodeposition of aluminum in controlled patterns a mechanical mask, having the patterns to be electroplated with aluminum cut out of the mask, was placed over the cathode area facing the anode before each plating run. The mechanical masks normally were Teflon or polyphenolic sheets, 0.010 to 0.030 inch thick.

(ii) Preparation of Stock Solution A: Benzene-Aluminum Bromide Complex

The apparatus used in the preparation of these electrolytes consisted of a 2,000 ml. 3-neck round bottom flask equipped with a reflux condenser connected to a gas trap, hydrogen bromide inlet tube, argon inlet tube, magnetic stirrer, and water bath.

160 g. of 99.9% aluminum wire were cut into small pieces, and washed with aqueous 2 N potassium hydroxide, water (3 times), methanol (3 times) and benzene (3 times). Then, the aluminum was placed into the 2,000 ml 3-neck round bottomed flask under an atmosphere of argon. 800 ml. of reagent-grade benzene were added. Hydrogen bromide gas was bubbled into the mixture with stirring. The rate of addition of HBr was such that the temperature of the mixture did not rise above 30° C. After 15 to 30 minutes, the mixture turned yellow, then orange, and finally dark brown. Hydrogen bromide was bubbled into the mixture until approximately 95% of the solid aluminum have gone into solution. This took approximately 36 hours. Then the mixture was stirred under argon at room temperature overnight to allow the system to reach equilibrium (i.e., to allow the remaining aluminum to absorb the remaining HBr gas in solution). Now this stock solution of benzene-$Al_2$ $Br_6$-complex was ready for treatment with the ionic halide salts. Using the analytical methods described above, the benzene-$Al_2$ $Br_6$-complex stock solution, possessed the following characteristics: The resistivity was between 800–1,000 ohm centimeters; the $[H^+]$ concentration was less than 0.08 M; and the $[Al^{3+}]$ concentration was 3.8 M.

EXAMPLE 1—Benzene-$Al_2$ $Br_6$-Li Br 200 ml. of the above stock solution of benzene-$Al_2$ $Br_6$-complex was treated with 10 mole % Li Br relative to aluminum (6.6 g). Using a plating assembly as illustrated in FIG. 1, effective plating was achieved at voltage drops on the order of 2.0 volts. The thickness of plating for a 10 minute period was 400 microinches. The current density was 85 mA/cm$^2$. The cathode efficiency was 100%. The white aluminum deposits observed were 99.9% pure by analysis. The resistivity of the final solution was below 400 ohm/centimeter, as it was for all examples hereinafter set forth, except where specifically noted.

EXAMPLE 2—Benzene-$Al_2$ $Br_6$-Na Br 200 ml. of the above stock solution of benzene-$Al_2$ $Br_6$-complex was treated with 10 mole % Na Br relative to aluminum (7.8 g). Using a plating assembly as illustrated in FIG. 1, effective plating was achieved at voltage drops on the order of 2.0 volts. The thickness of plating for a 10 minute period was 425 microinches; the current density was 95 mA/cm$^2$; and the cathode efficiency was 100%. Analytically pure white deposits of aluminum were observed.

EXAMPLE 3—Benzene-$Al_2$ $Br_6$-KBr 200 ml. of the above stock solution of benzene-$Al_2$ $Br_6$-complex was treated with 19 mole % KBr relative to aluminum (9.0 g). Using an identical plating assembly as in the above examples, effective plating was achieved at voltage drops on the order of 2.0 volts. The thickness of plating for a 10 minute period was 500 micro-inches and the current density was approximately 125 mA/cm$^2$. The cathode efficiency was 100%. 99.9% pure, white deposits of aluminum were observed.

EXAMPLE 4—Benzene-$Al_2$ $Br_6$-$NH_4$ Br 200 ml. of the above stock solution of benzene-$Al_2$ $Br_6$ complex was treated with 10 mole % $NH_4$ Br relative to aluminum (7.4 g). White deposits of aluminum 405 microinches thick, were observed when plating was performed in the FIG. 1 assembly, previously described. The current density was 87 mA/cm$^2$.

EXAMPLE 5—Benzene-$Al_2$ $Br_6$-Be $Br_2$ 200 ml. of the above stock solution of benzene-$Al_2$ $Br_6$-complex was treated with 10 mole % $BeBr_2$ relative to aluminum (12.8 g). Under identical plating conditions as described with reference to Example 1, the following results were obtained. Thickness of plating was 385 microinches; current density was 70 mA/cm$^2$; and cathode efficiency was 90%.

EXAMPLE 6—Benzene-$Al_2$ $Br_6$-Mg $Br_2$ 200 ml. of the above stock solution of benzene-$Al_2$ $Br_6$-complex was treated with 10 mole % Mg $Br_2$ relative to aluminum (14.0 g). Using identical plating conditions as described in EXAMPLE 1, the following results were observed: thickness of plating was 356 microinches; current density was 71 mA/cm$^2$; and cathode efficiency was 89%.

(iii) Preparation of Stock Solution B: Toluene-Aluminum Bromide Complex

The procedure for the preparation of the benzene-aluminum bromide complex of Stock Solution A was repeated utilizing 160 g of aluminum and 780 ml. of reagent-grade toluene (instead of benzene). This stock solution of toluene-$Al_2$ $Br_6$-complex had a resistivity of 1,700 ohm/centimeter, its $[Al^{+3}]$ concentration was 3.78 M and the $H^+$ ion concentration was below 0.1 Molar.

EXAMPLE 7—Toluene-$Al_2$ $Br_6$-5 mole % Li Br

Treating 100 ml. of stock solution B with 5 mole % Li Br relative to aluminum (3.3 g) gave a solution with a resistivity of 550 ohm-centimeters when plating was performed in the FIG. 1 system at 2.2 volts. White deposits of aluminum, 148 microinches in thickness were observed.

EXAMPLE 8—Toluene-$Al_2$ $Br_6$-10 mole % Li Br

Another 5 mole % Li Br relative to aluminum was added to the solution of EXAMPLE 7 to yield a solution with a resistivity of 250 ohm-centimeters. Plating with this solution in the FIG. 1 system at 2.2 volts resulted in white deposits of aluminum, 248 microinches thick.

EXAMPLE 9—Toluene-$Al_2$ $Br_6$-15 mole % Li Br

A further 5 mole % of Li Br was added to the solution of EXAMPLE 8 to yield a solution with a resistivity of 242 ohm-centimeters. When plating was attempted in the FIG. 1 system, using this solution, no deposits of aluminum were observed.

EXAMPLE 10—Toluene-$Al_2$ $Br_6$-20 mole % Li Br

An additional 5 mole % Li Br (3.3 g) was added to the solution of EXAMPLE 9. This solution had a resistivity of 315 ohm-centimeters. However, when plating attempts were made using this solution, in the FIG. 1 system, the results were negative, i.e., no plating of aluminum was observed.

tures or solvents other than benzene or toluene, are summarized.

TABLE I

| EXAMPLE | COMPLEX | | | | RELATIVE RATING | TYPE OF DEPOSITS AND COMMENTS |
|---|---|---|---|---|---|---|
| 18 | Benzene - $Al_2Br_6$ | (3.8M) | - LiBr | (10 Mole %) | Excellent | White, ductile |
| 19 | Benzene - $Al_2Br_6$ | (3.8M) | - NaBr | (10 Mole %) | Excellent | White, smooth |
| 20 | Benzene - $Al_2Br_6$ | (3.8M) | - KBr | (10 Mole %) | Excellent | White, smooth |
| 21 | Benzene - $Al_2Br_6$ | (3.8M) | - $NH_4Br$ | (10 Mole %) | Very Good | White, fairly adherent |
| 22 | Benzene - $Al_2Br_6$ | (3.8M) | - $BeBr_2$ | (10 Mole %) | Good | White, brittle |
| 23 | Benzene - $Al_2Br_6$ | (3.8M) | - $MgBr_2$ | (10 Mole %) | Good | White, poor adherence |
| 24 | Toluene - $Al_2Br_6$ | (3.78M) | - LiBr | (12 Mole %) | Excellent | White, ductile |
| 25 | Toluene - $Al_2Br_6$ | (3.78M) | - NaBr | (12 Mole %) | Excellent | White, adherent |
| 26 | Toluene - $Al_2Br_6$ | (3.78M) | - KBr | (12 Mole %) | Excellent | White, adherent |
| 27 | Toluene - $Al_2Br_6$ | (3.78M) | - $NH_4Br$ | (10 Mole %) | Very Good | White, fairly adherent |
| 28 | Toluene - $Al_2Br_6$ | (3.78M) | - $BeBr_2$ | (10 Mole %) | Good | White, brittle |
| 29 | Toluene - $Al_2Br_6$ | (3.78M) | - $MgBr_2$ | (8 Mole %) | Good | White, poor adherence |
| 30 | Toluene - $Al_2I_6$ | (2.8M) | - NaI | (5 Mole %) | Good | Off-white, adherent |

TABLE II

| EXAMPLE | COMPLEX | RELATIVE RATING | TYPE OF DEPOSITS AND COMMENTS |
|---|---|---|---|
| 31 | Cyclohexane - $Al_2Br_6$ (3.2M) - KBr (11 Mole %) | Fair | White, thin film, $[Al^{+3}]$ concentration is lower than normal |
| 32 | Cyclohexane: benzene (1:1) - $Al_2Br_6$ (3.5M) - KBr - (10 Mole %) | Good | White, smooth |
| 33 | Cyclohexane: toluene (1:1) $Al_2Br_6$ (4.1M) - KBr - (15 Mole %) | Good | White, smooth |
| 34 | $CS_2$ - $Al_2Br_6$ (3.0M) - KBr - (7 Mole %) | Poor | Grey to black deposits |
| 35 | $[CH_3]_2S$ - $Al_2Cl_6$ (3.9M) - KCl - (10 Mole %) | Fair | Grey, adherent |
| 36 | THF - $Al_2Cl_6$ (3.0M) - LiCl - (10 Mole %) | Good | White, smooth |
| 37 | $CS_2$: toluene (1.3) $Al_2Br_6$ (3.5M) - NaBr (11 Mole %) | Poor | Grey to black deposits |
| 38 | $C_2H_4I_2$ - $Al_2I_6$ (3.2M) - NaI (6 Mole %) | Fair | Grey deposits |
| 39 | THF: Benzene (4:1) $Al_2Br_6$ and $Al_2Cl_6$ (1:1) (4.0M) - KBr:KCl(1:1) (12 Mole %) | Excellent | White, smooth, brittle |

EXAMPLES 11-15: Toluene-$Al_2$ $Br_6$-MBr ($MBr_2$)

One hundred ml. batches of the toluene-$Al_2$ $Br_6$-complex solution (Stock Solution B) were reacted separately with 10 mole % (relative to aluminum concentration) of the following ionic halide salts: Na Br (3.9 g), KBr (4.5 g), $NH_4$ Br (3.7 g) Be $Br_2$ (6.4 g), and Mg $Br_2$ (7.0 g). The resulting solutions were investigated to determine whether electrodeposition of aluminum was feasible using these solutions. In general, when plating was performed using each of the above solutions in a FIG. 1 plating system, indistinguishable results were observed. White deposits of 99.9%, pure aluminum were observed in each instance.

EXAMPLE 16—Preparation of $Al_2$ $Cl_6$ Electrolytes

Using an identical apparatus and procedure as described above in the preparation of stock solution A, hydrogen chloride gas was allowed to react with the aluminum instead of hydrogen bromide gas.

EXAMPLE 17—Preparation of $Al_2I_6$ Electrolytes

Using an identical apparatus and basically similar procedure as described in the preparation of Stock Solution A, the following procedure was carried out: Instead of bubbling hydrogen bromide gas into the mixture of aluminum metal and solvent, hydrogen iodide was added to the mixture at a rate such that the reaction would not be too vigorous.

Plating electrolyte systems employing both Stock solutions A and B are summarized below in TABLE I. In TABLE II, other solutions, employing solvent mix- The following Stock Solution C was prepared utilizing halogen and hydrogen halide reactants with aluminum, and follows the reactions earlier set forth in Equations (IIIa) and (IIIb). The Stock Solution C utilizes toluene as the solvent.

The apparatus used was similar to that used in the preparation of the benzene-aluminum bromide complex Stock Solution A, described above. 160 g of 99.9% aluminum wire were cut into small pieces, and washed with aqueous 2 N potassium hydroxide, water (3 times), methanol (3 times) and toluene (3 times). Then, the aluminum was placed into the 2,000 ml 3-neck round bottomed flask under an atmosphere of argon. Bromide (450 ml.) was added dropwise to the aluminum with stirring. Cooling with a water bath was applied as necessary. After all the bromide has been added, the mixture was stirred at 35° C. under argon overnight. Then 1,100 ml. of toluene was added, and hydrogen bromide gas was bubbled into the solution until the resistivity of the solution drops to 300 to 350 ohm-centimeters. Potassium bromide and 5 g of aluminum were added to the above solution. The mixture was stirred under argon at room temperature overnight to allow the system to reach equilibrium (i.e., to allow the remaining aluminum to absorb the remaining excess HBr gas in solution). The $[Al^{+3}]$ concentration was 2.95 M and the resulting $[H^+]$ ion concentration was 0.13 M. This Stock Solution is equivalent to Stock Solutions A and B in terms of its plating efficiency and stability.

Modifications of the foregoing will become apparent to those skilled in the art. I intend, therefore, to be bound only by the scope of the claims which follow.

I claim:

1. A method for forming an electroplating solution for aluminum or its alloys which includes:

reacting a given quantity of aluminum, in the presence of an organic, substantially anhydrous non-Lewis base solvent, with (a) a member of the group consisting essentially of a hydrogen halide, and halogen plus a hydrogen halide, in a quantity in excess of that required to produce an aluminum halide but below that required to produce, at equilibrium, a hydrogen ion concentration of less than 0.4 molar; and with (b) about 0.5–16 mole % metallic halide based on the initial mole quantity of said aluminum, said metallic halide being selected from the group consisting of the halides of Lithium, Sodium, Potassium, Beryllium, Magnesium, and the Ammonium ion, to form a plating solution containing an aluminum cationic plating species having an aluminum ion molarity of below about 5.0 molar whereby said plating solution will plate aluminum onto a cathode, at low voltages on the order of below about 5 volts.

2. The method of claim 1, wherein the organic, anhydrous, non-Lewis base solvent consists essentially of a compound selected from the group consisting of benzene, toluene, carbon disulfide, cyclohexane, dimethylsulfide, tetrahydrofuran and diiodoethane, taken singly or in admixture.

3. The plating solution formed by the method of claim 1.

4. The method of claim 1 in which said hydrogen halide or halogen plus hydrogen halide is supplied in a molar ratio with the aluminum of at least 3:1.

5. The method of claim 1 in which the said aluminum ion molarity of said plating solution is maintained between about 2.7 and 4.2 molar during plating.

6. The plating solution formed by the method of claim 5.

7. The method of claim 1 further characterized by a resistivity in said plating solution of from about 100–400 ohm/centimeter.

8. The method of claim 5 further characterized by a resistivity in said plating solution of from about 100–400 ohm/centimeter.

9. The method of claim 1 wherein said aluminum ion molarity in said plating solution is maintained between about 2.7 and 4.2 molar, and said hydrogen ion molarity is maintained at between about 0.01 M and 0.3 molar, the relationship between ion molarity and hydrogen ion molarity substantially following the formula $y=5.27X+2.6173$ where $y$=aluminum ion molarity and $X$=hydrogen ion molarity.

10. The method of claim 1 wherein said aluminum ion molarity in said plating solution is maintained between about 2.7 and 4.2 molar, and said hydrogen ion molarity is maintained at between about 0.01 molar and 0.3 molar.

11. In a method for forming an electroplating solution for aluminum or its alloys, the steps of:

reacting a given quantity of aluminum, in an organic essentially anhydrous, non-Lewis base solvent, with a member of the group consisting essentially of a hydrogen halide, and a halogen plus hydrogen halide, in a molar quantity in excess of that required to produce an aluminum halide having an aluminum ion molarity of between about 2.7 and about 5.0 molar and a hydrogen ion concentration of less than about 0.4 molar, at equilibrium, in a first solution; and adding to said first solution, from about 0.5–16 mole % metallic halide, based on said initial given quantity of said aluminum, said metallic halide being selected from the halides consisting of Lithium, Sodium, Potassium, Beryllium, Magnesium, and Ammonium ions, to form a plating solution containing an aluminum cationic plating species having an aluminum ion molarity of below about 5.0 molar whereby said plating solution will plate aluminum onto a cathode, at low voltages on the order of below about 5 volts.

12. In a method of claim 11, the solvent which consists essentially of a compound selected from the group consisting of benzene, toluene, carbon disulfide, cyclohexane, dimethylsulfide, tetrahydrofuran and diiodoethane, taken singly or in admixture.

13. The plating solution formed by the method of claim 11.

14. The method of claim 11 in which said hydrogen halide and/or halogen plus hydrogen halide is supplied in a molar ratio with the aluminum of in excess of 3:1.

15. The method of claim 11 in which the said aluminum ion molarity of said plating solution is maintained between about 2.7 and 4.2 molar and said hydrogen ion molarity lies between 0.01 molar and about 0.3 molar, during plating.

16. The plating solution formed by the method of claim 11.

17. The method of claim 11 in which the said aluminum ion molarity of said plating solution is maintained between about 2.7 and 4.2 molar and said hydrogen ion molarity lies between 0.01 molar and about 0.3 molar, during plating, the relationship between aluminum ion molarity and hydrogen ion molarity substantially following the formula $y=5.27X+2.6173$ where $y$=aluminum ion molarity and $x$=.hydrogen ion molarity.

18. The method of claim 11 further characterized by a resistivity in said plating solution of from about 100–400 ohm/centimeter.

19. The method of claim 11 further characterized by a resistivity in said plating solution of from about 100–400 ohm/centimeter.

20. A method for forming an electroplating solution for aluminum or its alloys which comprises:

reacting a given quantity of aluminum, in an organic substantially anhydrous, non-Lewis base solvent, selected from the group consisting essentially of benzene, toluene, carbon disulfide, cyclohexane, dimethylsulfide, tetrahydrofuran and diiodoethane, taken singly, or in admixture, with a member of the group consisting essentially of hydrogen halide, and a halogen plus a hydrogen halide in a molar quantity in excess of that required to produce an aluminum cationic species having an aluminum ion molarity of between about 2.7 molar and about 4.2 molar and a hydrogen ion concentration of between about 0.01 molar and 0.3 molar, at equilibrium, in a first solution; and adding to said first solution, from about 0.5–16 mole % metallic halide, based on said initial given quantity of said aluminum, said metallic halide being selected from the halides consisting of Lithium, Sodium, Potassium, Beryllium, Magnesium and Ammonium ions, to form a plating solution containing an aluminum cationic plating species having an aluminum ion molarity of below about 4.2 molar whereby said plating solution has a resistivity of from about 100–400 ohm/centimeter and will plate aluminum onto a cathode at low voltages on the order of below about 5 volts.

21. The plating solution formed by the method of claim 20.

* * * * *